US009615716B2

(12) United States Patent
Yan

(10) Patent No.: US 9,615,716 B2
(45) Date of Patent: Apr. 11, 2017

(54) AUTOMATIC CLEANING DEVICE

(71) Applicant: Jason Yan, Taipei County (TW)

(72) Inventor: Jason Yan, Taipei County (TW)

( * ) Notice: Subject to any disclaimer, the term of this patent is extended or adjusted under 35 U.S.C. 154(b) by 114 days.

(21) Appl. No.: 14/247,173

(22) Filed: Apr. 7, 2014

(65) Prior Publication Data

US 2015/0190028 A1 Jul. 9, 2015

(30) Foreign Application Priority Data

Jan. 3, 2014 (TW) ..... 103100129 A

(51) Int. Cl.
*A47L 11/16* (2006.01)
*A47L 11/24* (2006.01)
*A47L 11/40* (2006.01)

(52) U.S. Cl.
CPC ..... *A47L 11/4072* (2013.01); *A47L 11/16* (2013.01); *A47L 11/24* (2013.01); *A47L 11/4038* (2013.01); *A47L 11/4066* (2013.01); *A47L 2201/00* (2013.01)

(58) Field of Classification Search
CPC ..... A47L 11/14; A47L 11/16; A47L 11/24; A47L 11/282; A47L 11/283; A47L 11/4038; A47L 11/4063; A47L 11/4066; A47L 2201/00
USPC ..... 15/49.1, 98
See application file for complete search history.

(56) References Cited

U.S. PATENT DOCUMENTS 3,321,787 A * 5/1967 Myers ..... A47L 11/00 15/1.7
4,719,659 A * 1/1988 Urakami ..... A47L 11/16 15/49.1
2014/0196231 A1* 7/2014 Park ..... A47L 11/4066 15/98

FOREIGN PATENT DOCUMENTS

GB 771959 * 4/1957

* cited by examiner

*Primary Examiner* — Mark Spisich
(74) *Attorney, Agent, or Firm* — Chun-Ming Shih

(57) ABSTRACT

An automatic cleaning device includes a main body and an operating unit. The operating unit is disposed on the lower side of the main body and includes several wheels. At least one of these wheels tilts downward with respect to the main body and the wheels may cause the automatic cleaning device to move around. In addition, with the aid of a piece of fabric, brush or dust removal paper attached to each wheel, the automatic cleaning device of the present invention can freely move around and clean up all corners of a flat floor.

7 Claims, 8 Drawing Sheets

AUTOMATIC CLEANING DEVICE

BACKGROUND OF THE INVENTION

1. Field of the Invention

The invention generally relates to a cleaning device. More particularly, the invention relates to an automatic cleaning device that can move around in all directions to reach each corner of a flat floor.

2. Description of the Prior Art

As population density becomes higher and higher, available space in a home becomes smaller and smaller. Home appliances become more automated, smarter and smarter, more lightweight and more compact. A good example would be a self-propelled automatic cleaning machine, which propels itself on a floor to clean up the floor after it is turned on.

As of now, most of automatic cleaning machines on the market can only move in straight lines; therefore, they can not reach corners and areas around the legs of desks and chairs. In addition, because cleaning units of most of these machines are fixedly disposed on these machines and hence these cleaning units are easily worn out, their service life is relatively short and they have to be replaced within a relatively short period.

SUMMARY OF THE INVENTION

The object of the present invention is to provide an improved automatic cleaning device. The automatic cleaning device of the present invention comprises a main body and an operating unit. The operating unit is disposed on the lower side of the main body and includes several wheels. At least one of these wheels tilts downward with respect to the main body and the wheels may cause the automatic cleaning device to move around.

A cleaning unit is provided on each wheel. Friction between the cleaning unit and a floor may cause the automatic cleaning device to move around. The cleaning unit may be fabric, brush or dust removal paper.

The main body comprises a base portion and an upper portion. Several speed reducing units are provided on the base portion. Each speed reducing unit is linked up with a corresponding wheel and causes the latter to rotate. The upper portion is disposed on top of the base portion to enclose the speed reducing units.

A control unit is provided inside the main body and is connected with the operating unit. The control unit serves to control the rotational speed of each wheel and hence the direction of movement of the automatic cleaning device.

A charging and discharging unit is provided inside the main body and may provide electricity to power up the operating unit and the control unit.

At least one of these wheels tilts downward with respect to the main body and the wheels may cause the automatic cleaning device to move around.

The operating unit includes a first wheel and a second wheel and both of the wheels tilt downward with respect to the main body. In use, the two wheels rotate in opposite direction and friction caused by such rotation may cause the automatic cleaning device to move around.

In comparison to conventional cleaning devices, the automatic cleaning device of the present invention has the following advantages:

1. Unlike the conventional cleaning devices, which move in straight lines, the automatic cleaning device of the present invention can move in all directions to reach all corners of a flat floor.

2. Unlike the conventional cleaning devices, in the automatic cleaning device of the present invention, its contact area with a floor may be altered at any time. Therefore, corners may be reached and cleaned up effectively with the automatic cleaning device.

In addition, the automatic cleaning device of the present invention can move around in all directions and its cleaning unit, which is fabric, brush or dust removal paper is replaceable. Therefore, the automatic cleaning device of the present invention has a longer service life and is more economical because there is no need to replace most of its parts.

These features and advantages of the present invention will be fully understood and appreciated from the following detailed description of the accompanying Drawings.

DETAILED DESCRIPTION OF THE PREFERRED EMBODIMENTS

Figure 1:
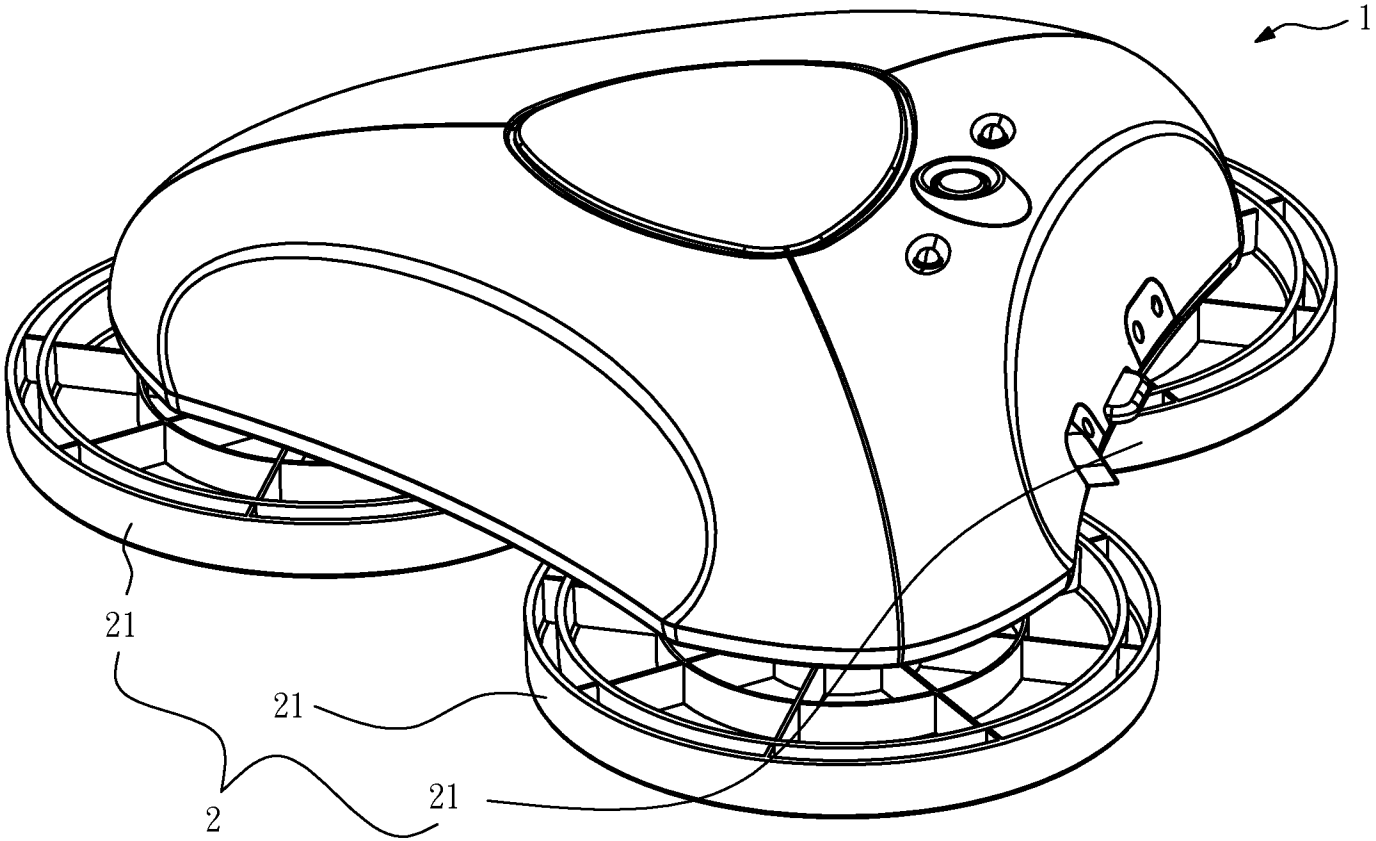
FIG. 1 is a perspective view of the automatic cleaning device of the present invention.

First, please see FIG. 1, which is a perspective view of the automatic cleaning device of the present invention. The automatic cleaning device of the present invention comprises a main body 1 and an operating unit 2. The operating unit 2 is disposed on the lower side of the main body 1 and includes several wheels 21.

Figure 2:
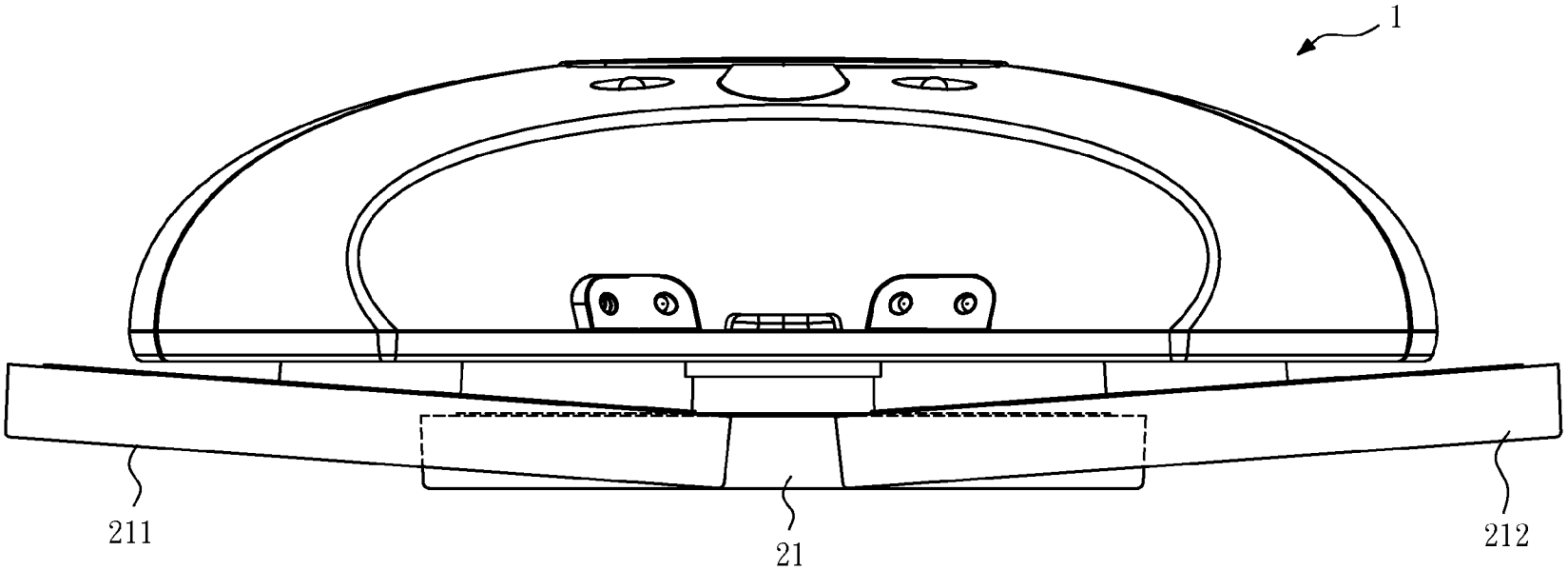
FIG. 2 is a side view of the automatic cleaning device of the present invention.
Figure 3:
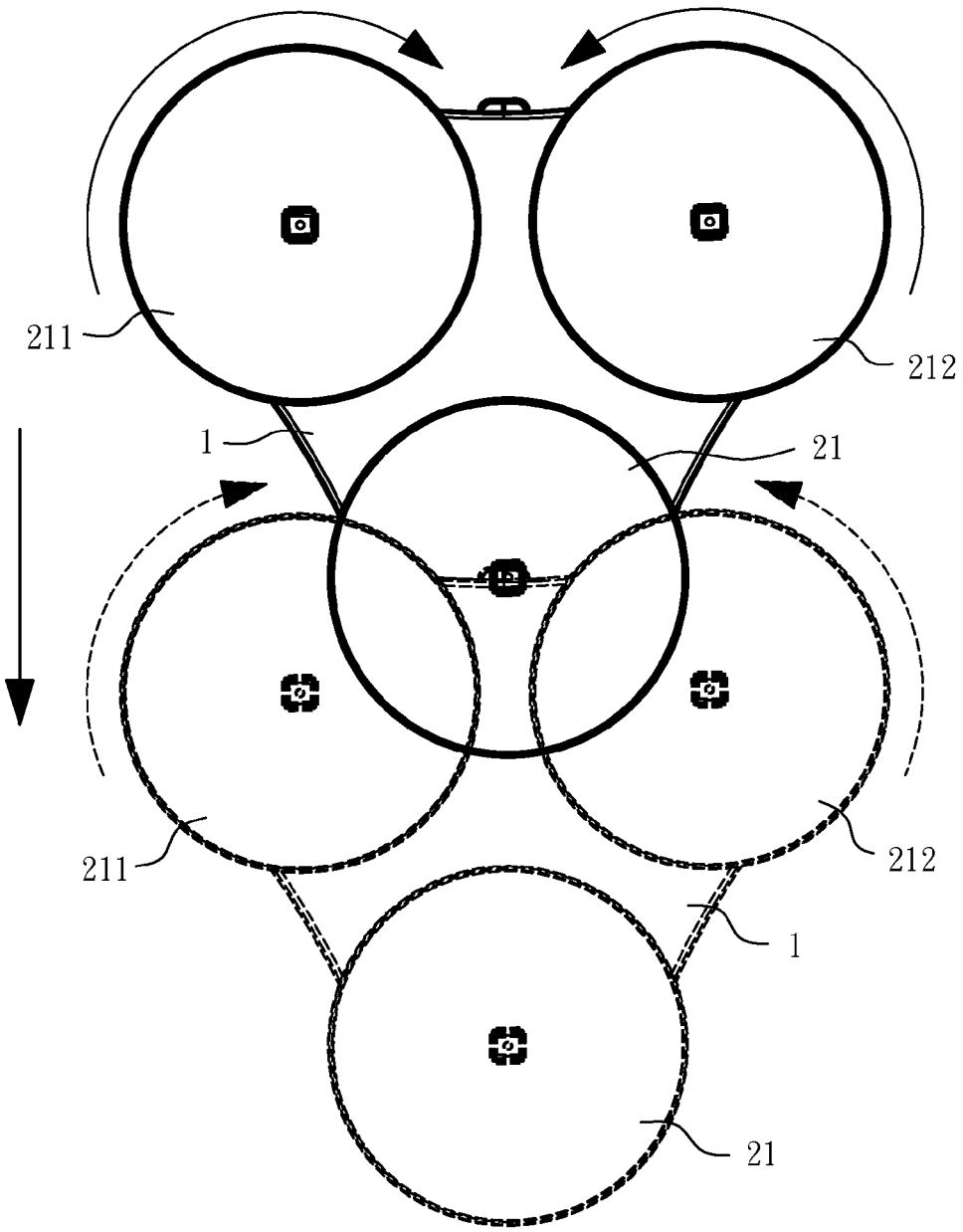
FIG. 3 is a view schematically illustrates a movement caused by the two wheels that rotate in opposite direction.
Figure 4:
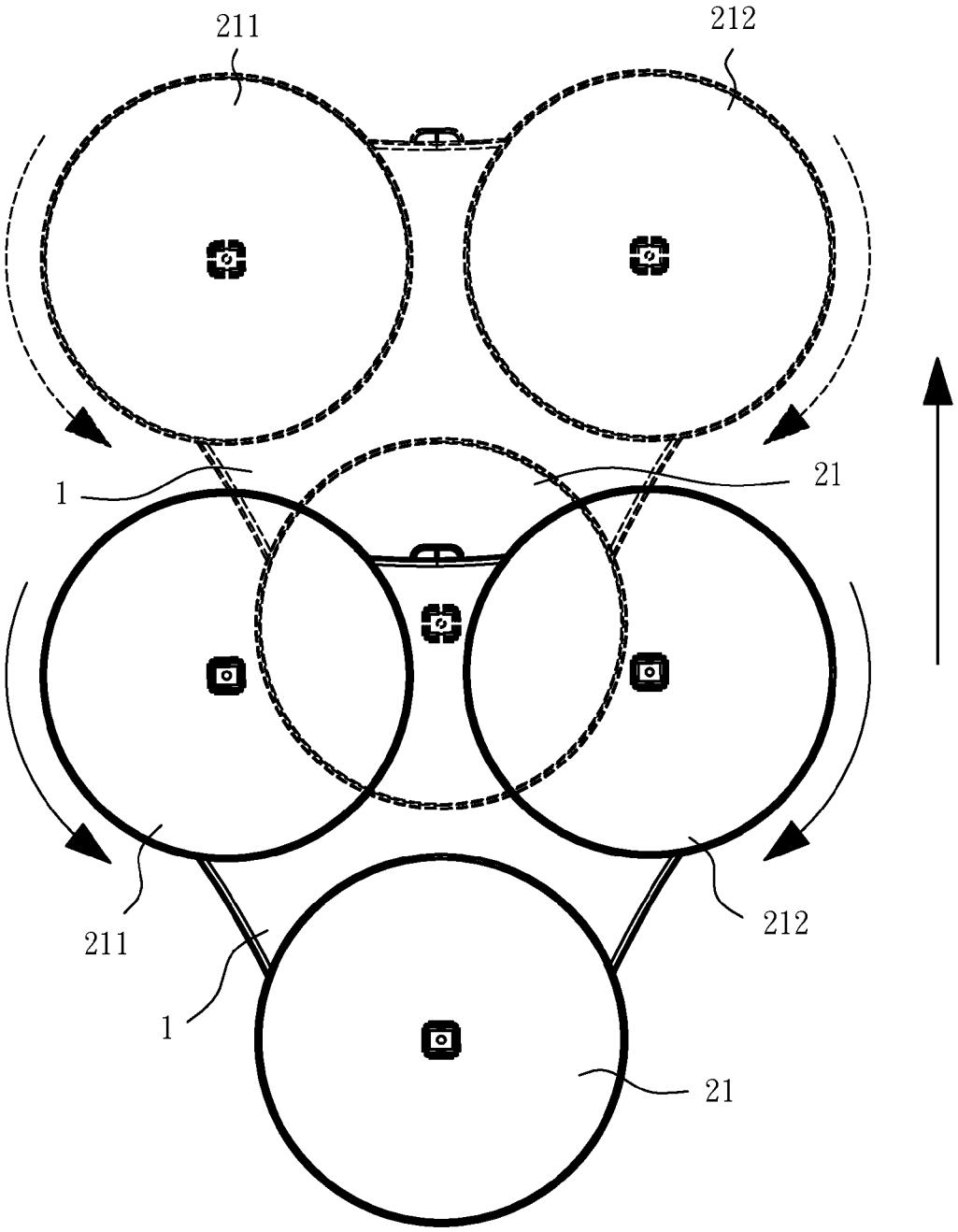
FIG. 4 is a view schematically illustrates another movement caused by the two wheels that rotate in opposite direction.

Next, please refer to FIG. 2, which is a side view of the automatic cleaning device of the present invention. The operating unit 2 also includes a first wheel 211 and a second wheel 212. Both wheels 211 and 212 tilt downward with respect to the main body 1. FIGS. 3 and 4 illustrate the automatic cleaning device in use. In use, the two wheels 211 and 212 lie flat on a floor and because the two wheels 211 and 212 rotate in opposite direction, friction caused by such rotation and the weight of the automatic cleaning device may cause the automatic cleaning device to move around.

Figure 5:
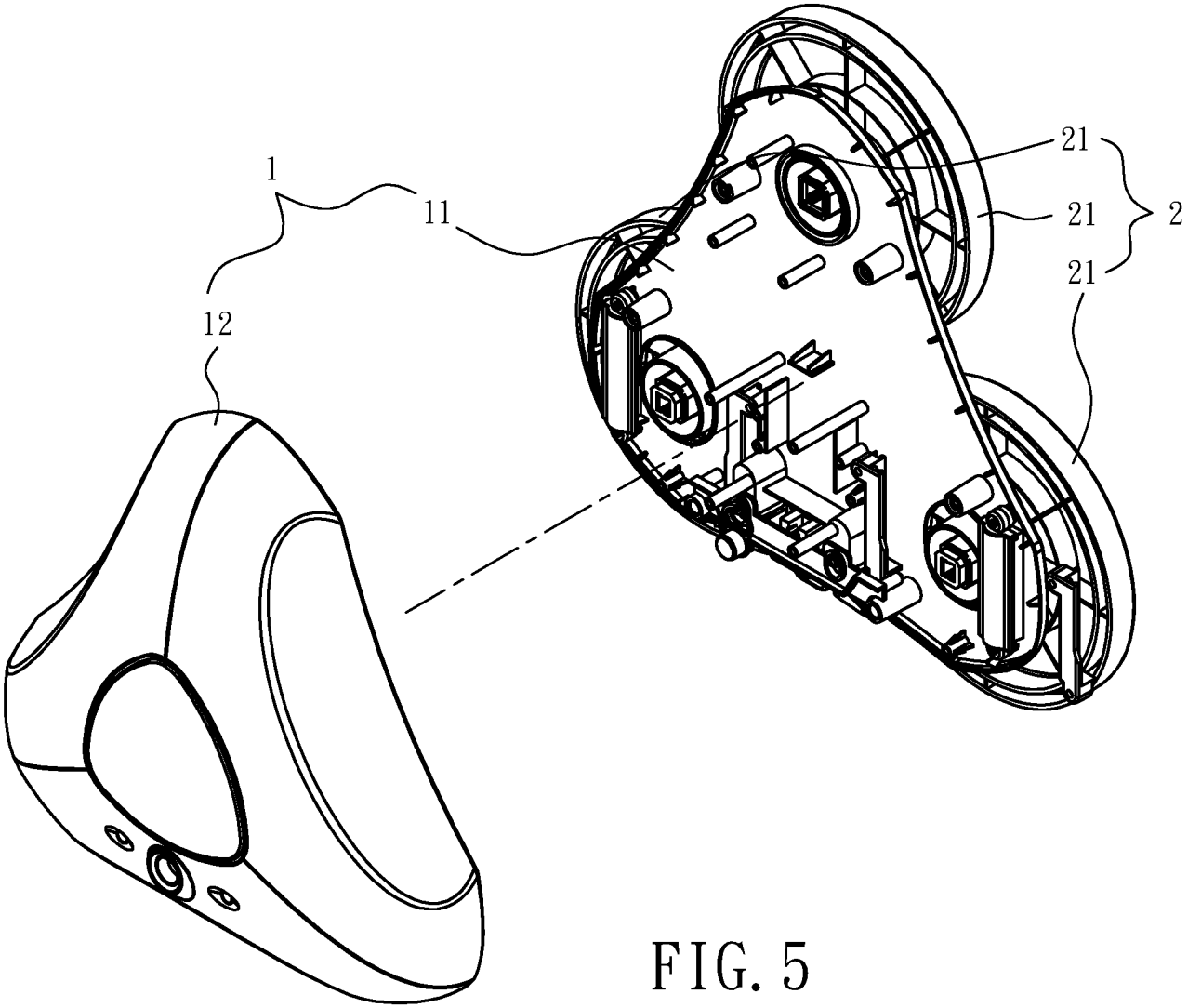
FIG. 5 is an exploded view showing the inner structure of the automatic cleaning device of the present invention.

Please see FIG. 5, which is an exploded view showing the inner structure of the automatic cleaning device of the present invention. The main body 1 comprises a base portion 11 and an upper portion 12. The operating unit 2 is disposed on the lower side of the base portion 11 and the upper portion 12 is disposed on top of the base portion 11.

Figure 6:
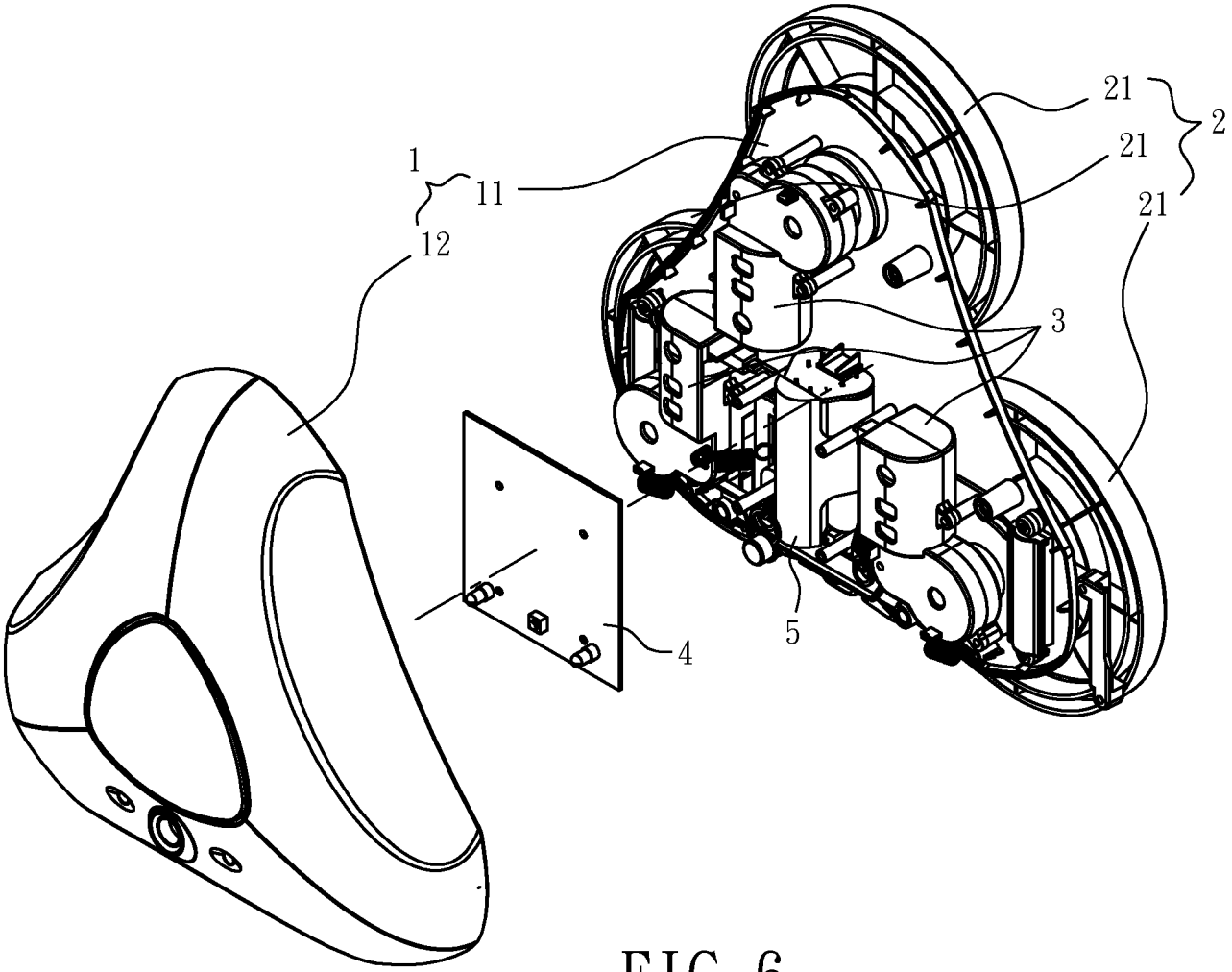
FIG. 6 is another exploded view showing the inner structure of the automatic cleaning device of the present invention.

Next, please see FIG. 6, which is another exploded view showing the inner structure of the automatic cleaning device of the present invention. Several speed reducing units 3 are provided on the base portion 11. Each speed reducing unit 3 is linked up with a corresponding wheel 21 and causes the latter 21 to rotate. The upper portion 12 and the base portion 11 can enclose or house the speed reducing units 3. A control unit 4 is provided inside the main body 1 and is connected with the operating unit 2. The control unit 4 serves to control the rotational speed of each wheel 21 and hence the automatic cleaning device may move around to reach each corner of a flat floor. A charging and discharging unit 5 is provided inside the main body 1 and may provide electricity to power up the operating unit 2 and the control unit 4.

Figure 7:
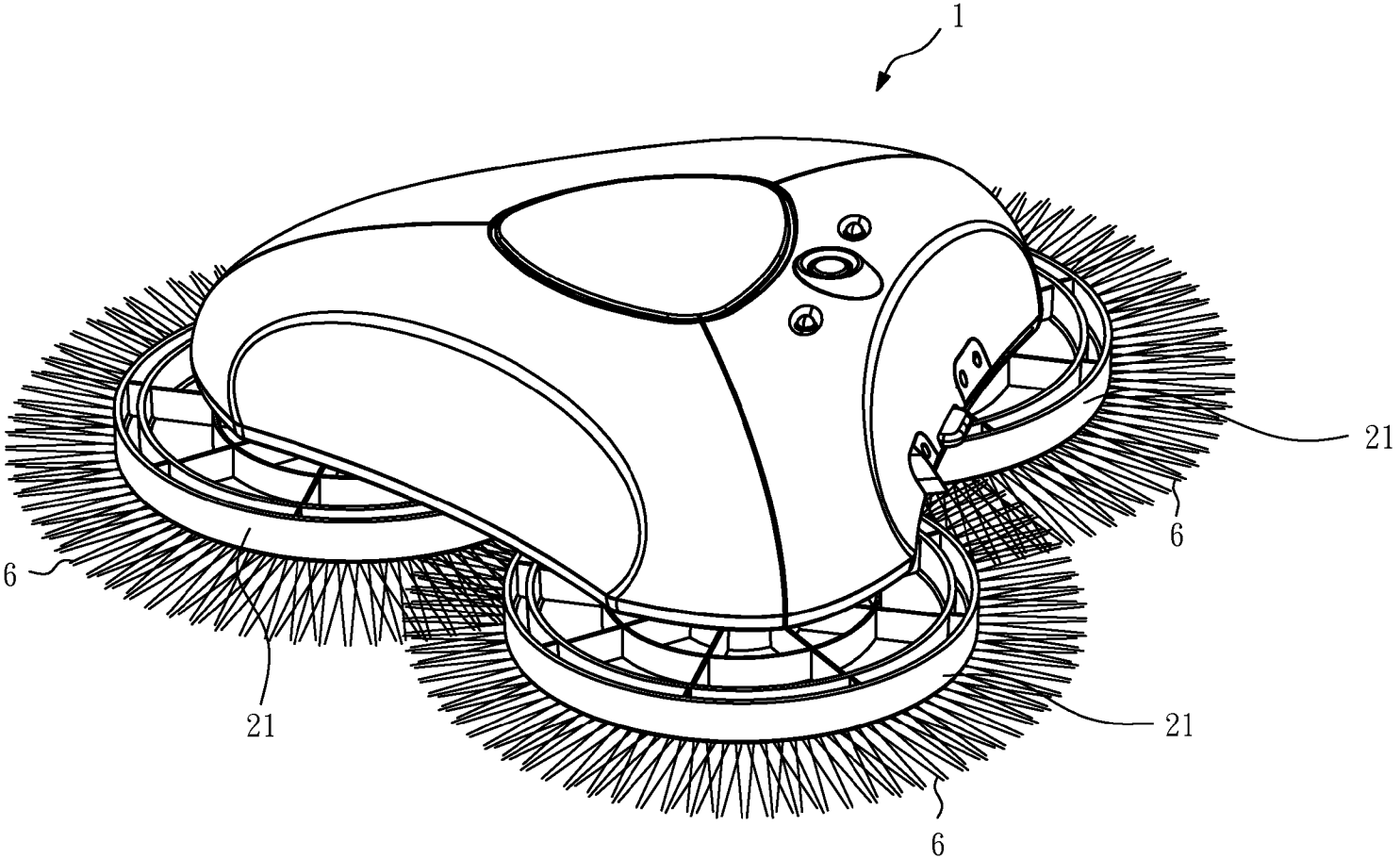
FIG. 7 illustrates the automatic cleaning device attached with a cleaning unit in use.
Figure 8:
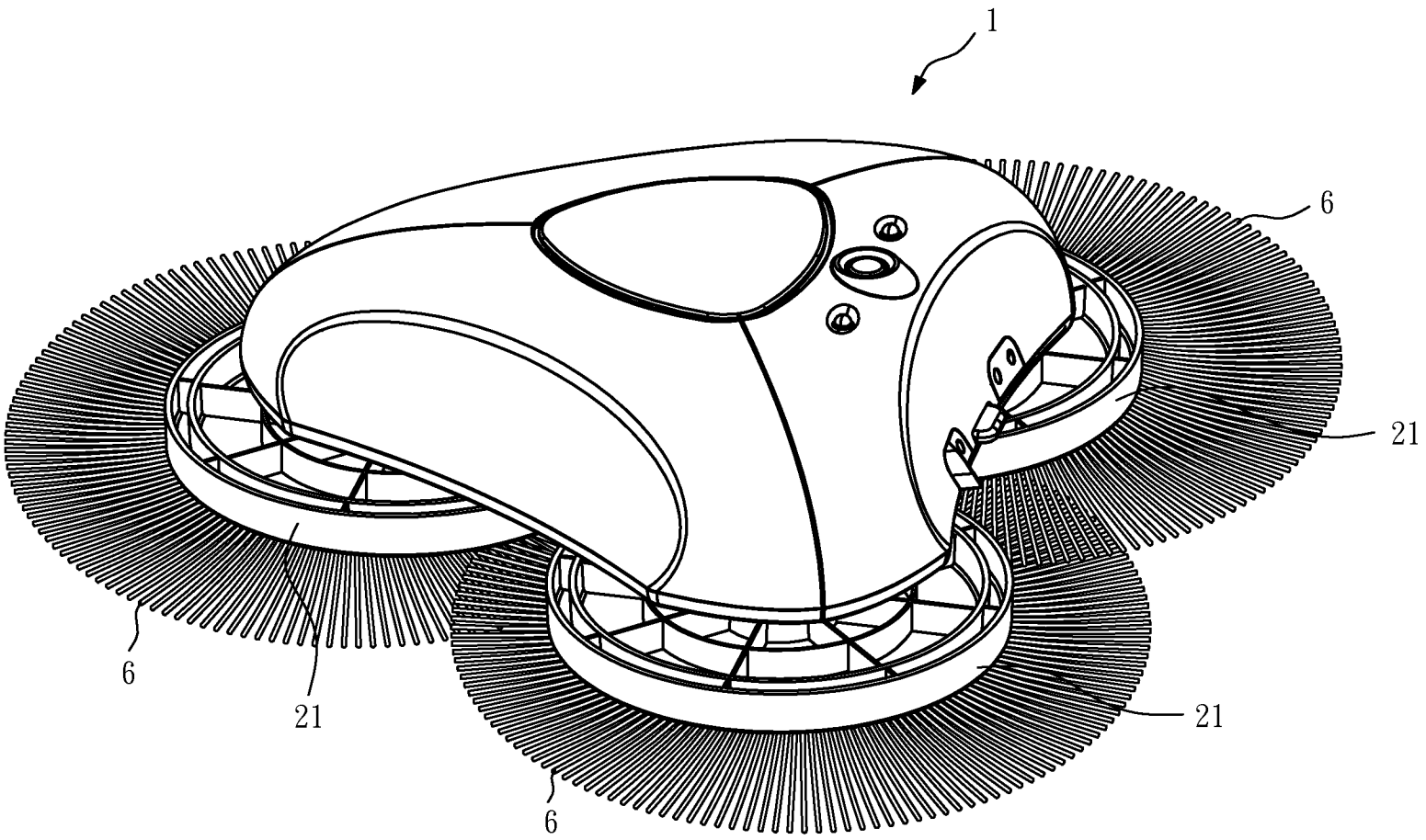
FIG. 8 illustrates the automatic cleaning device attached with another cleaning unit in use.

Please refer to FIGS. 7 and 8, which illustrate the automatic cleaning device attached with a cleaning unit 6 in use. In use, the cleaning unit 6 is sandwiched between each wheel 21 and a floor. The friction between the cleaning unit 6 and the floor may cause the automatic cleaning device to move around. The cleaning unit 6 may be fabric, brush, dust removal paper, etc. as according to the actual need.

In comparison to other cleaning devices of the prior art, the automatic cleaning device of the present invention can move around in all directions and the cleaning unit 6 of the automatic cleaning device is replaceable. Therefore, the automatic cleaning device of the present invention has a longer service life and is more economical because there is no need to replace most of its parts.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An automatic cleaning device, comprising:

a main body; and an operating unit, disposed on the lower side of the main body and including three disc-shaped wheels, each of the wheels being driven for rotation about a generally vertical axis and including a cleaning surface on a bottom surface thereof facing the underlying surface to be cleaned, characterized in that two of the three wheels are tilted downward with respect to the main body such that the bottom surface of the two wheels and the plane defined by each of the two wheels is tilted with respect to the underlying surface being cleaned as well as the axes of rotation of the two wheels being tilted with respect to the vertical;

the other of the three wheels is oriented such that the bottom surface thereof is generally parallel or horizontal relative to the underlying surface being cleaned and the axis of rotation thereof is non-tilted and aligned with the vertical, wherein a cleaning unit is provide on each wheel, and friction between the cleaning unit and a floor causes the automatic cleaning device to move around.

2. The automatic cleaning device as in claim 1, wherein friction caused by the two wheels being tilted with respect to the underlying surface being cleaned cause the automatic cleaning device to move around.

3. The automatic cleaning device as in claim 1, wherein the two wheels being tilted with respect to the underlying surface being cleaned rotate in opposite direction and friction caused by such rotation drives the automatic cleaning device to move around.

4. The automatic cleaning device as in claim 1, wherein the main body comprises a base portion and an upper portion and several speed reducing units are provided on the base portion, characterized in that each speed reducing unit is linked up with a corresponding wheel and causes a latter of the corresponding wheel to rotate and that the upper portion is disposed on top of the base portion to house the speed reducing units.

5. The automatic cleaning device as in claim 4, wherein a control unit is provided inside the main body and is connected with the operating unit, characterized in that the control unit serves to control the rotational speed of each wheel and hence the direction of movement of the automatic cleaning device.

6. The automatic cleaning device as in claim 5, wherein a charging and discharging unit is provided inside the main body and provides electricity to power up the operating unit and the control unit.

7. The automatic cleaning device as in claim 1, wherein the cleaning unit may be fabric, brush or dust removal paper.

* * * * *